United States Patent [19]

Dearing

[11] Patent Number: 4,838,348

[45] Date of Patent: Jun. 13, 1989

[54] WELL PACKER BRAKE

[75] Inventor: David G. Dearing, Duncanville, Tex.

[73] Assignee: Dresser Industries, Inc., Dallas, Tex.

[21] Appl. No.: 149,639

[22] Filed: Jan. 28, 1988

[51] Int. Cl.[4] ..... E21B 23/06

[52] U.S. Cl. ..... 166/136; 188/83; 188/166

[58] Field of Search ..... 166/136, 214, 241, 118; 188/83, 166

[56] References Cited

U.S. PATENT DOCUMENTS 2,777,522 1/1957 Page ..... 285/145 X 4,593,765 6/1986 Greenlee ..... 166/387

*Primary Examiner*—William P. Neuder

[57] ABSTRACT

A well packer brake mechanism includes opposed rings releasably holding brake members in an inward brake released position. The rings are movable away from one another for allowing outward movement of the brake members to their operating position under influence of biasing springs.

21 Claims, 4 Drawing Sheets

WELL PACKER BRAKE

BACKGROUND OF THE INVENTION

This application relates to the art of well packers and, more particularly, to a well packer that can be selectively moved from one location to another within a well casing. The invention is particularly applicable to a well packer brake mechanism and will be described with specific reference thereto. However, it will be appreciated that the invention has broader aspects, and that the brake mechanism can be used in other combinations and in other environments.

Well packers commonly include an elongated mandrel having an external generally J-shaped longitudinally extending slot receiving a follower on an external sleeve. The slot has longitudinally-spaced opposite shoulders cooperable with the follower for selectively holding the packer in a locked sealing condition, or holding the packer in an unlocked position for movement to a new location in a well casing. The follower sleeve carries a brake mechanism engageable with the well casing wall for inhibiting rotation of the follower sleeve. This enables rotation of the mandrel relative to the follower and follower sleeve for selectively releasing the follower from engagement with the slot shoulders.

Brake mechanisms of the type described are relatively complicated, and difficult to manufacture and assemble. It would be desirable to have a simplified brake mechanism for use on well packers.

SUMMARY OF THE INVENTION

A brake mechanism of the type described includes brake means movable between an inward brake released position and an outward brake operating position. Opposed rings cooperate with the brake means for releasably holding same in the released position. Movement of the rings away from one another allows outward movement of the brake means to its operating position under influence of biasing means.

In one arrangement, the brake mechanism includes brake sleeve means having a circumferential channel therein with opposed channel sides. The brake means comprises brake members received in the channel, and the rings are positioned between the sides of the brake members and the channel sides. Cooperating surface means is provided between the brake members and rings for moving the brake members inwardly when the rings move toward one another, and for providing outward movement of the brake members when the rings move away from one another. In the outward operating position of the brake members, the rings engage the channel sides.

In accordance with another aspect of the invention, adjustment means is provided for selectively adjusting the spacing between the rings. Selective operation of the adjustment means moves the rings toward one another for locating the brake members in the inward released position. The end portion of the adjustment means defines abutment means for engaging one of the rings and preventing movement of same away from the other ring. The brake sleeve means and adjustment means are movable longitudinally away from one another for releasing the one ring from engagement with the abutment means, and allowing outward movement of the brake members to the operating position.

The brake sleeve means is releasably connected with the mandrel by shearable means. An elongated rod extending through the mandrel has an operating sleeve on its lower end portion extending upwardly in surrounding relationship to the lower end portion of the mandrel adjacent the brake sleeve means. Upward movement of the rod and its operating sleeve relative to the mandrel provides engagement between the operating sleeve means and the brake sleeve means for shearing the shearable means and moving the brake sleeve means longitudinally on the mandrel. In a preferred arrangement, the operating sleeve means is also releasably connected with the mandrel by shearable means that is independent of the shearable means connecting the brake sleeve means with the mandrel. Movement of the brake sleeve means and operating sleeve means away from one another disengages the one ring from the abutment means carried by the operating sleeve means to enable outward movement of the brake members.

The mandrel has an external generally J-shaped slot receiving a follower on the brake sleeve means. Longitudinally-spaced shoulders in the slot selectively cooperate with the follower for holding the packer assembly in a locked or open position. The slot is machined into the outer surface of the mandrel, and has a depth less than the thickness of the mandrel so that the inner surface of the mandrel is circumferentially continuous in the area of the slot. This prevents leakage through the slot as compared to prior arrangements where the slot extended completely through the entire thickness of the mandrel.

It is a principal object of the present invention to provide an improved brake mechanism.

It is also an object of the invention to provide an improved brake mechanism for use with well packers.

It is a further object of the invention to provide an improved well packer.

It is an additional object of the invention to provide a well packer having a brake mechanism that is economical to manufacture and assemble, and reliable in operation.

DESCRIPTION OF A PREFERRED EMBODIMENT

Figure 1:
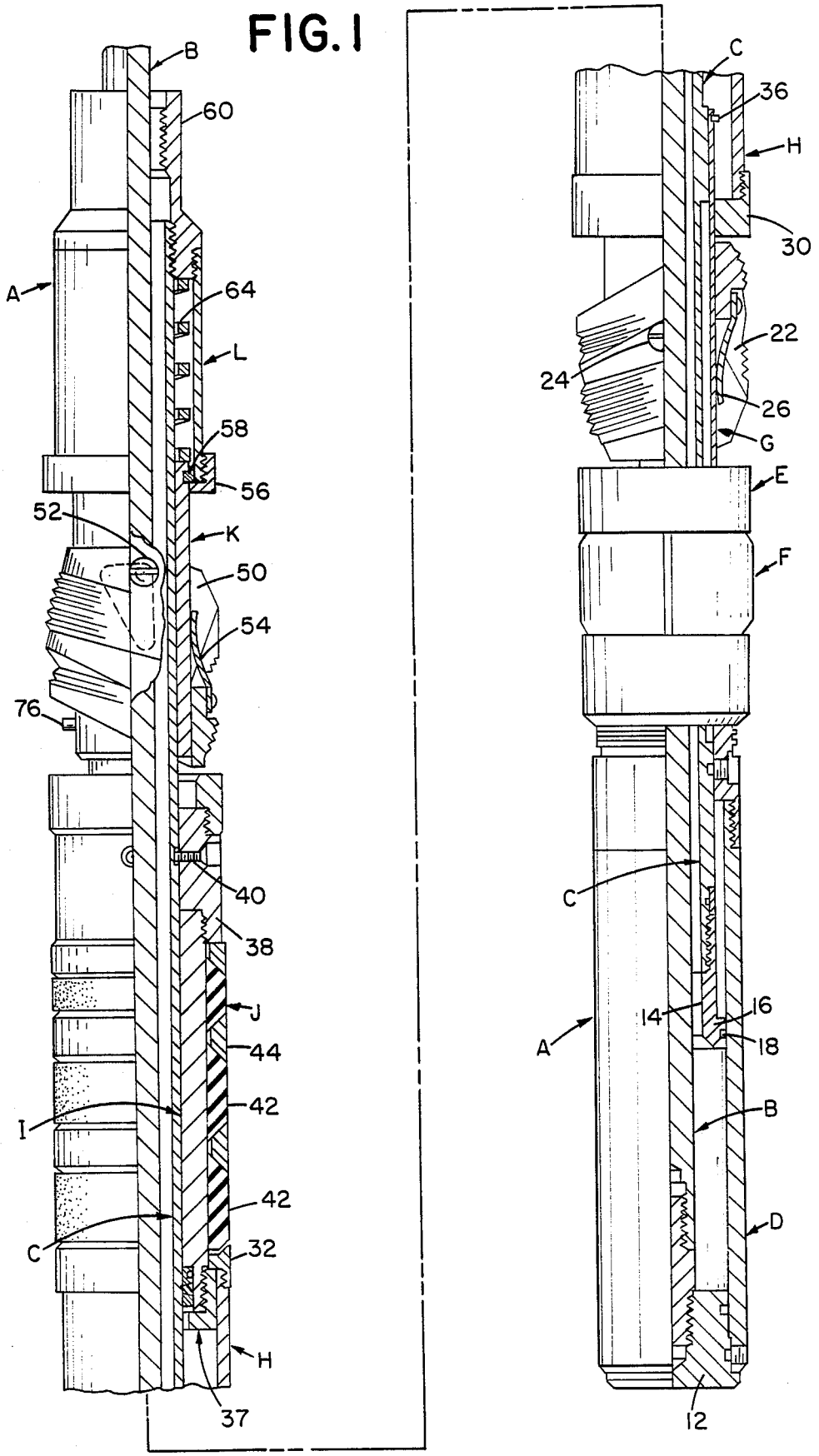
FIG. 1 is an elevational view of a well packer having the improvements of the present application incorporated therein, and with portions cut-away and in section for clarity of illustration.

Referring now to the drawing, wherein the showings are for purposes of illustrating a preferred embodiment of the invention only, and not for purposes of limiting same, FIG. 1 shows a well packer A sealable within a well casing for separating upper and lower zones.

An elongated central rod B extends concentrically through an elongated hollow generally cylindrical mandrel C. A plug member 12 attached to the lower end portion of rod B has operating sleeve means D attached thereto and extending upwardly in surrounding relationship to a lower end portion 14 of mandrel C.

The lower end of mandrel C is longitudinally-spaced from plug member 12 as shown in the drawing for allowing relative longitudinal movement between rod B and mandrel C, and between mandrel C and operating sleeve means D. The lower end of mandrel C has a circumferential projection 16 thereon receiving an O-ring 18 to provide sliding sealing engagement between circumferential projection 16 and the inner surface of operating sleeve means D.

Brake sleeve means E separate from operating sleeve means D is slidably carried on mandrel C, and carries brake means F movable from the inward released position shown to an outward operating position engaging a well casing. Engagement of brake means F with a well casing holds brake sleeve means E against rotation so that mandrel C can be rotated relative thereto.

Lower lock sleeve means G slidable on mandrel C is connected with brake sleeve means E for longitudinal movement in unison therewith. A lock member 22 is pivotally connected to lower lock sleeve means G at pivot connection 24 for clockwise pivotal movement into locking engagement with a well casing. A leaf spring 26 attached to lock member 22 engages lower lock sleeve means G for normally pivoting lock member 22 counterclockwise to the released position shown in FIG. 1. Lower lock member 22 locks well packer A against downward movement in a well casing while being slidable upwardly in the well casing when in its locked position.

Seal compressing sleeve means H has a lower collar 30 slidable on the upper end portion of lower lock sleeve means G, and an upper collar 32 slidable on seal carrying sleeve means I. A suitable circumferential groove in the outer surface of lower lock sleeve means G adjacent the upper end thereof receives a split circumferential ring 36 for preventing complete displacement of collar 30 from lower lock sleeve means G.

Seal carrying sleeve means I has a lower collar seal assembly 36 in sliding sealing engagement with mandrel C. Upper collar 32 on seal compressing sleeve means H radially overlaps collar seal assembly 36, to lock seal compressing sleeve means H and seal carrying sleeve means I against complete separation, while allowing overlapping movement of same toward one another.

An upper collar 38 on seal carrying sleeve means I is slidable on mandrel C, and has shearable screws 40 projecting into a circumferential groove in mandrel C. Seal carrying sleeve means I carries a seal assembly J that is expandable outwardly into sealing engagement with the inner surface of a well casing. Seal assembly J includes a plurality of circumferential elastomeric members 42 having circumferential wedge rings 44 separating same. Axial compression of seal assembly J causes elastomeric members 42 to expand outwardly into sealing engagement with a well casing.

Upper lock sleeve means K has an upper lock member 50 pivotally connected thereto at 52. A leaf spring 54 attached to upper lock member 50 normally pivots same clockwise to the released position shown in FIG. 1. Upper lock member 50 is pivotable counterclockwise into gripping engagement with a well casing for locking well packer A against upward movement in the well casing. In its locked position, upper lock member 50 cannot move upwardly but is capable of downward movement.

Spring housing sleeve means L has a lower collar 56 through which the upper end portion of upper lock sleeve means K extends. Collar 56 radially overlaps a split ring 58 on upper lock sleeve means K to prevent complete separation therebetween. Spring housing sleeve means L is attached to an upper mandrel collar 60 that is attached to the upper end portion of mandrel C. A coil spring 64 is positioned between mandrel C and spring housing sleeve means L, and has its upper end engaging mandrel collar 60, and its lower end engaging the upper end of upper lock sleeve means K.

When well packer A is manufactured, operating sleeve means D and brake sleeve means E are releasably connected to mandrel C by shearable screws. Lower and upper lock members 22, 50 are also connected to their respective sleeves G, K by shearable screws for releasably holding such locked members in their released positions. The shearable screws facilitate transportation, storage and initial positioning of the well packer in a well casing.

Well packer A is lowered into a well casing to a desired depth by use of a wireline or the like. A setting tool is connected with mandrel collar 60 and rod B. An upward force is applied to rod B while a simultaneous downward force is applied to mandrel C through mandrel collar 60. These forces cause shearing of the shearable screws releasably connecting operating sleeve means D and brake sleeve means E to mandrel C.

Once the shearable screws have been sheared, operating sleeve means D, brake sleeve means E and lower lock sleeve means G begin moving upwardly relative to mandrel C. Lower lock member 22 engages lower collar 30 on seal compressing sleeve means H for pivoting lower lock member 22 clockwise about pivot 24. This shears the shear screw connecting lock member 22 to its sleeve means G, and moves lock member 22 into its locked position firmly engaging the interior surface of the well casing. The construction and pivotal arrangement of lower lock member 22 is such that in its locked position it cannot move downwardly relative to the well casing but can slide upwardly relative thereto.

The movements previously described also cause seal compressing sleeve means H to begin moving upwardly for compressing seal means J, and expanding same outwardly toward the well casing. The force acting on collar 38 of seal carrying sleeve means I becomes great enough to shear screws 40, and free seal carrying sleeve means I for movement relative to mandrel C. Upper lock member 50 engages collar 38 for pivoting same counterclockwise about pivot 52 toward its locked position engaging the inner surface of the well casing. The lock member shear screws are sheared during initial movement thereof. In its locked position, upper lock member 50 is locked against upper movement within the well casing, but is capable of sliding downward movement under application of sufficient force. Downward movement of mandrel C and spring housing sleeve means L causes collar 56 to engage upper lock member 50, and spring 64 becomes compressed by upper lock sleeve means K.

Figure 6:
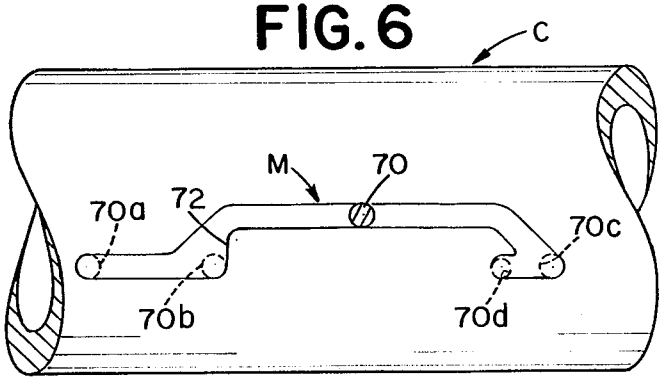
FIG. 6 is a schematic showing of the positions of a follower in a generally J-shaped slot in the mandrel of the packer.

With reference to FIG. 6, the external surface of mandrel C has a longitudinally extending generally J-shaped slot M therein, and the brake sleeve means E of FIG. 1 has a follower 70 received in such slot. When the well packer is factory assembled with the various shear pins holding components against movement relative to the mandrel, follower 70 may be in an intermediate solid line position in slot M as shown in FIG. 6.

During setting of the well packer for moving lower and upper lock members 22, 50 to their locked positions, relative movement between mandrel C and follower 70 results in the follower being located at the extreme upper end of slot M as shown at 70*a*. At this time, an upward force is no longer applied to rod B, and the force acting on mandrel C through mandrel collar 60 is reversed so that an upward pulling force is applied to mandrel C. This causes mandrel C to move upwardly until follower 70 bottoms against a slot shoulder 72 in position 70*b*. A continued upward force applied to mandrel C while shoulder 72 engages follower 70 causes upward sliding movement of lower lock member 22 relative to the well casing for finally compressing seal assembly J and expanding same into firm sealing engagement with the interior of the well casing. When the upward pulling force on mandrel C is released, coil spring 64 continues to bias mandrel C upwardly to maintain slot shoulder 72 in engagement with the follower at position 70*b*.

Figure 2:
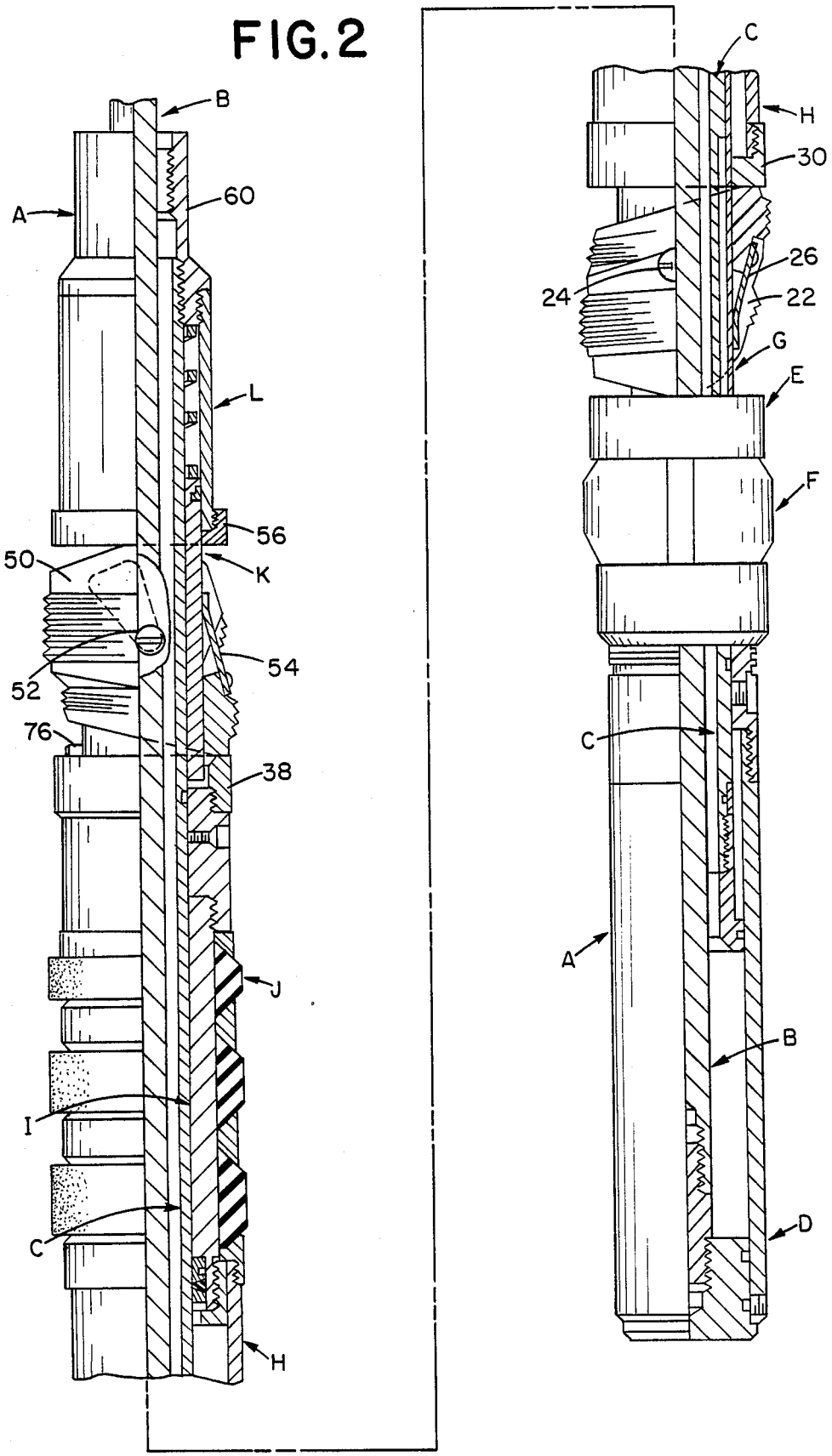
FIG. 2 is a view similar to FIG. 1, and showing the packer in its locked position.

When the pulling force on rod B ceases, and the force on mandrel C is reversed to pull same upwardly, operating sleeve means D and brake sleeve means E longitudinally separate from one another. This separation results in outward movement of brake means F into frictional engagement with the interior of the well casing for holding brake sleeve means E against rotation relative thereto. The engagement of brake means F with the well casing is such that brake sleeve means E can slide longitudinally upwardly and downwardly in the well casing, but the force of engagement of the brake means is sufficient to prevent rotation of brake sleeve means E while mandrel C is rotated relative thereto. After the operations previously described, the various parts are in the position shown in FIG. 2.

When it is desired to release well packer A from its set position within the well casing, for movement to a new location or removal from the well casing, mandrel C is rotated relative to brake sleeve means E for moving slot shoulder 72 of FIG. 6 out of engagement with follower 70*b*, which then becomes aligned with the main longitudinal portion of slot M. This frees mandrel C for upward movement under the influence of biasing spring 64, and upward movement of mandrel C effectively causes follower 70 to move downwardly in slot M.

With reference to FIG. 1, an outwardly extending kicker 76 on mandrel C may extend through an elongated opening in upper lock sleeve means K for cooperation with an internal shoulder within lock member 50 for initially unsetting same from its locked position by imparting an impact thereto tending to move lock member 50 clockwise about pivot 52. This frees lock member 50 for movement to the released position shown in FIG. 1, and all of the various sleeves on the mandrel are free for longitudinal movement and expansion. The compressive force stored within seal assembly J also causes longitudinal separation of the various sleeves for movement back to the unlocked position of FIG. 1, from the position of FIG. 2.

With lock members 22, 50 in the position of FIG. 1, mandrel C is moved upwardly and then rotated relative to brake sleeve means E for locating follower 70 at the bottom of the generally J-shaped slot. Telescoping movement of the various sleeves, and movement of locking members 22, 50 to their locking positions, can take place only by relative longitudinal movement between mandrel C and brake sleeve means E. With the follower located at the bottom of the generally J-shaped slot, such relative movement is prevented. For shifting the entire packer assembly A upwardly within the well casing, the follower is located at position 70*c*. For downward movement of the well packer A, the follower is located in position 70*d* while a pushing force is applied to mandrel C. The frictional engagement of brake means F with the well casing is such that upward and downward movement of the entire packer assembly is still possible. Once the well packer is in the desired new position within the well casing, the operations previously described with respect to FIG. 1 are repeated for moving the various parts to the position shown in FIG. 2.

Figure 3:
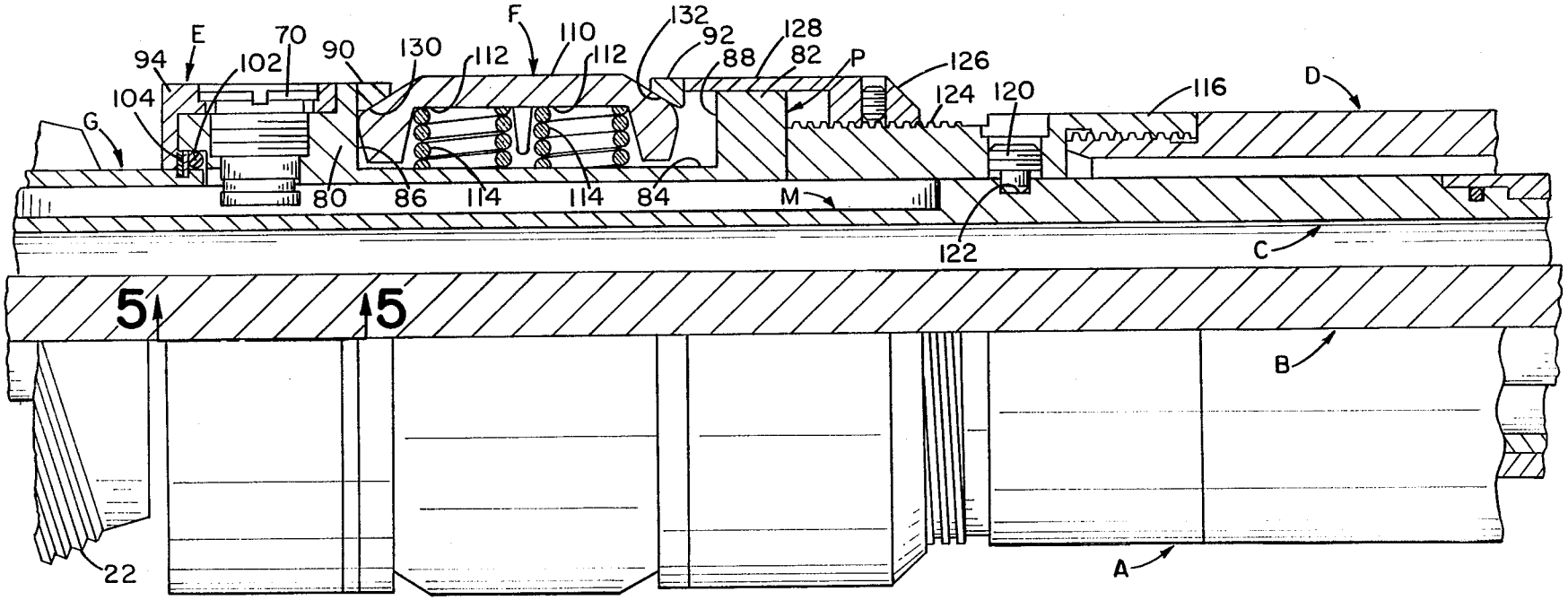
FIG. 3 is an elevational view of the brake mechanism used on the well packer of FIGS. 1 and 2, and with portions cut-away and in section for clarity of illustration.
Figure 4:
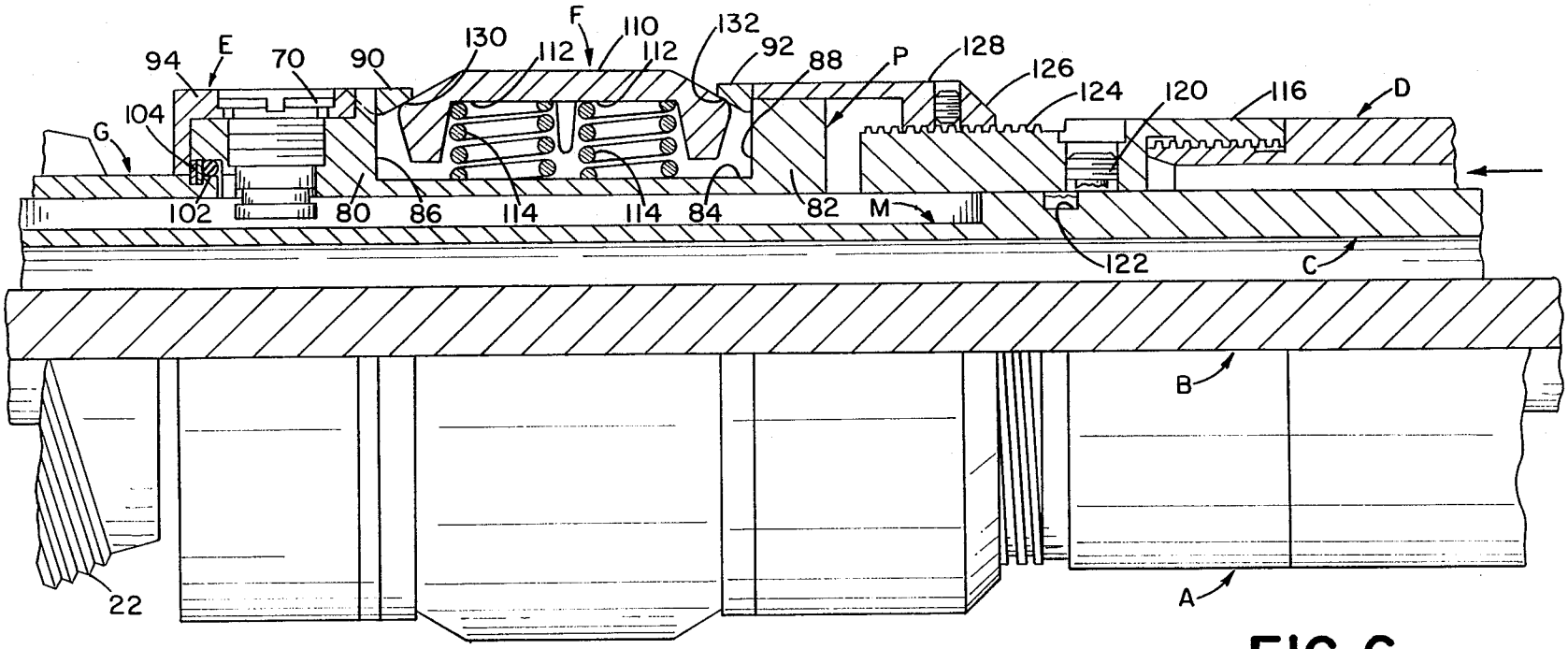
FIG. 4 is a view similar to FIG. 3, and showing the brake mechanism in its operating position.
Figure 5:
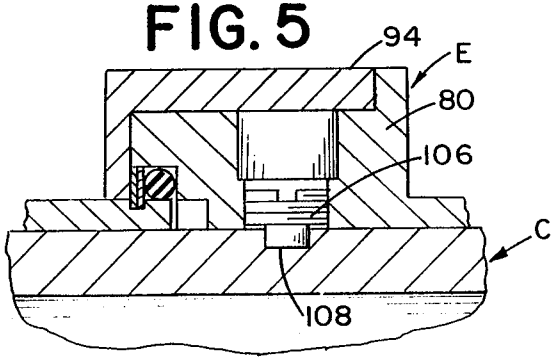
FIG. 5 is a partial cross-sectional elevational view taken generally on line 5—5 of FIG. 3.

The brake mechanism constructed in accordance with the present application is particularly shown with reference to FIGS. 3–5. A plurality of arcuate segments, only one of which is shown at P in FIG. 3, are assembled together into a cylindrical sleeve closely receivable over mandrel C. The assembled sleeve includes longitudinally-spaced outwardly extending circumferential projections 80, 82 between which a circumferential channel 84 is defined with opposite channel sides 86, 88. The sleeve is made in a plurality of individual arcuate segments P so that such segments can be longitudinally offset or circumferentially overlapped for extending a pair of rings 90, 92 over end projections 82 and into alignment with channels 84 on all the segments. The segments can then be moved into their cylindrical sleeve configuration. A generally L-shaped retainer ring 94 is closely received over circumferential projection 80 for holding the individual arcuate segments P in their assembled cylindrical sleeve configuration.

An inner circumferential groove in circumferential projection 80 receives an O-ring 102 for sealing between circumferential projection 80 and lower lock sleeve means G. An external circumferential groove in lower lock sleeve means G receives a split ring 104 that is overlapped by retainer ring 94 to prevent separation between brake sleeve means E and lower lock sleeve means G. Circumferential projection 80 has a radially-extending threaded hole therethrough for receiving follower screw 70 having its inner end portion received in generally J-shaped slot M. Follower screw 70 also has an enlarged head engaging retainer ring 94 for holding same in position on circumferential projection 80.

With reference to FIG. 5, circumferential projection 80 has a plurality of circumferentially-spaced radially-extending threaded holes therethrough receiving shearable screws 106 having shear portions extending into a circumferential groove 108 in the exterior of mandrel C.

Brake means F comprises a plurality of arcuate friction brake members 110 having a plurality of recesses 112 receiving coil springs 114 defining biasing means for biasing brake members 110 outwardly away from the longitudinal axis of packer A. Opposite rings 90, 92 can be placed at their extreme positions engaging channel sides 86, 88, and brake members 110 can then be rocked into position beneath the end rings. One side portion of a brake member 110 is laterally positionable beneath end ring 90 while the opposite side portion of the brake member is rocked into position in channel 84 past end ring 92.

Operating sleeve means D has an extension 116 attached thereto. A plurality of circumferentially-spaced radially-extending threaded holes in extension 116 receive shearable screws 120 having shear portions extending into a circumferential groove 122 in the exterior of mandrel C. Extension 116 is externally threaded as at 124 for threadably receiving a collar 126 having a cylindrical extension 128 overlying circumferential projection 82 for engaging end ring 92.

When packer A is initially set in a well casing, the initial upward force on rod B and operating sleeve means D, and the downward force on mandrel C, cause shearing of the shearable portions of shear screws 106, 120 to free operating sleeve means D and brake sleeve means E for upward movement on mandrel C. The threaded holes in sleeves D, E for the shearable screws remain filled and sealed by such screws after shearing of the shearable portions thereof extending into the circumferential grooves in mandrel C.

Collar 126 defines adjustment means for selectively moving end ring 92 toward or away from end ring 90. Cylindrical extension 128 on the adjustment means defines abutment means for engaging end ring 92, and holding same against movement away from end ring 90. End rings 90, 92 and brake member 110, have cooperating surface means thereon generally indicated at 130, 132. The cooperating surface means is in the form of cooperating inclined cam surfaces shaped such that movement of rings 90, 92 toward one another causes inward movement of brake members 110 to their released position. Movement of rings 90, 92 away from one another allows outward movement of brake members 110 under the influence of the biasing means defined by springs 114. Upon movement of operating sleeve means D and brake sleeve means E away from one another, adjustment means 126 moves to the right in FIG. 3 until end ring 92 engages channel side 88, and brake means F is then in its outward operating position shown in FIG. 4.

In the arrangement of the present application, the brake means defined by brake members 110 are movable inwardly toward the longitudinal axis of packer A to a released position, and are movable outwardly away from such axis to an operating position for engaging the interior surface of a well casing. Selective adjustment of adjustment means 126 holds end rings 90, 92 in a predetermined relationship to one another for holding brake members 110 in a desired inward released position. Longitudinal separation of sleeves D, E automatically provides rapid outward movement of brake members 110 to their operating position engaging the well casing.

In the arrangement of the present application, generally J-shaped slot M is machined into the exterior surface of mandrel C such that the interior of mandrel C in the vicinity of such slot is circumferentially continuous. This contrasts with prior arrangements where the slot extended completely through the entire thickness of the mandrel and leakage could occur through the slot. Also, the bottom of mandrel C is completely sealed by plug 12 and O-ring 18. Thus, pressure within the well casing below seal assembly J has no path to the interior of mandrel C.

Although the invention has been shown and described with respect to a preferred embodiment, it is obvious that equivalent alterations and modifications will occur to others skilled in the art upon the reading and understanding of this specification. The present application includes all such equivalent alterations and modifications, and is limited only by the scope of the claims.

I claim:

1. A brake mechanism including friction brake means for selectively applying a friction braking force and being movable inwardly and outwardly toward and away from a longitudinal axis between released and operating positions, biasing means for biasing said brake means outwardly to said operating position, opposite rings cooperating with said brake means for holding said brake means inwardly in said released position against the force of said biasing means, and said rings being movable away from one another for releasing said brake means for outward movement to said operating position by action of said biasing means.

2. The mechanism of claim 1 wherein said brake means comprises brake members having opposite sides extending transversely of said axis, said rings being positioned adjacent said sides of said brake members, and said brake members and rings having cooperating surface means thereon for moving said brake members inwardly when said rings move toward one another (and for allowing outward movement of said brake members when said rings move away from one another.)

3. The mechanism of claim 2 including adjustment means movable generally parallel to said axis for adjustably moving at least one said ring toward and away from the other said ring.

4. The mechanism of claim 1 including carrier means for carrying said brake means and including a circumferential channel in which said brake means and rings are received, said channel having opposite sides, and said rings being engageable with said channel sides when said brake means moves outwardly away from said axis.

5. The mechanism of claim 1 including carrier means for carrying said brake means and rings and being movable longitudinally of said axis, abutment means engageable with one said ring for holding same in a brake released position wherein said brake means is moved inwardly relative to said axis to said released position, and said carrier means being movable away from said abutment means for allowing said one ring to move away from the other said ring to release said brake means for outward movement to said operating position.

6. The mechanism of claim 5 wherein said abutment means is on adjustment means movable generally parallel to said axis for selectively varying the spacing between said rings.

7. The mechanism of claim 6 wherein said adjustment means comprises a generally cylindrical collar.

8. The mechanism of claim 1 in combination with a well packer on which said mechanism is mounted, said packer including an elongated mandrel, carrier means slidably received on said mandrel for carrying said brake means, an elongated slot in the outer surface of said mandrel, and said carrier means having follower means received in said slot for guiding relative movement between said carrier means and said mandrel.

9. The combination of claim 8 wherein said slot is generally J-shaped and has oppositely facing shoulders adjacent opposite end portions thereof for cooperating with said follower means for selectively stopping relative movement between said mandrel and said carrier means in one or the other opposite directions generally parallel to said axis.

10. The combination of claim 9 including shear pins cooperatively positioned between said mandrel and said carrier means for releasably holding said mandrel and carrier means against relative longitudinal movement.

11. A well packer including an elongated mandrel having brake sleeve means slidably received thereon, brake means carried by said brake sleeve means for selectively inhibiting movement of said brake sleeve means, said brake means being movable between an inner released position and an outer operating position, and spaced-apart opposed rings cooperating with said brake means and movable toward one another for moving said brake means to said released position.

12. The packer of claim 11 including biasing means for biasing said brake means to said operating position, said rings being operative to hold said brake means in said released position and being movable away from one another for allowing outward movement of said brake means under force of said biasing means.

13. The packer of claim 11 including rod means extending through said mandrel and having operating sleeve means attached thereto in surrounding relationship to said mandrel, said rod means and mandrel being longitudinally movable relative to one another, and said operating sleeve means being engageable with said brake sleeve means for moving said brake sleeve means relative to said mandrel.

14. The packer of claim 13 including shearable connecting means between said brake sleeve means and said mandrel and between said operating sleeve means and said mandrel.

15. The packer of claim 11 wherein said brake sleeve means includes a circumferential channel receiving said brake means and said rings, and cooperating surfaces on said brake means and said rings for moving said brake means inwardly when said rings move toward one another and for allowing outward movement of said brake means when said rings move away from one another.

16. The packer of claim 11 including adjustment means for selectively adjusting the spacing between said rings.

17. The packer of claim 11 including abutment means engaging one of said rings for releasably holding said rings against movement away from one another, and said brake sleeve means and abutment means being movable away from one another for providing movement of said rings away from one another.

18. The packer of claim 11 including a generally J-shaped slot in the outer surface of said mandrel, and follower means on said brake sleeve means received in said slot.

19. A well packer including an elongated mandrel having brake sleeve means slidably received thereon, a generally J-shaped slot in the outer surface of said mandrel, follower means on said brake sleeve means received in said slot, and said slot having a depth less than the thickness of said mandrel such that the inner surface of said mandrel is circumferentially continuous in the area of said slot.

20. A well packer including an elongated mandrel having brake sleeve means slidably received thereon, an elongated rod extending through said mandrel and having operating sleeve means attached thereto in surrounding relationship to a portion of said mandrel adjacent said brake sleeve means, whereby relative longitudinal movement between said rod and mandrel provides relative longitudinal movement between said mandrel and said brake sleeve means by cooperation between said operating sleeve means and said brake sleeve means.

21. The packer of claim 20 including shearable connecting means between said mandrel and said brake sleeve means and between said mandrel and said operating sleeve means.

* * * * *